United States Patent [19]

Haftmann

[11] 4,270,867

[45] Jun. 2, 1981

[54] INK RIBBON MAGAZINE FOR ENDLESS INK RIBBON CARTRIDGE

[75] Inventor: Johannes Haftmann, Borchen-Doerenhagen, Fed. Rep. of Germany

[73] Assignee: Nixdorf Computer AG, Paderborn, Fed. Rep. of Germany

[21] Appl. No.: 56,498

[22] Filed: Jul. 11, 1979

[30] Foreign Application Priority Data

Sep. 7, 1978 [DE] Fed. Rep. of Germany ... 7826639[U]

[51] Int. Cl.[3] ..... B41J 33/14

[52] U.S. Cl. ..... 400/207; 400/196.1

[58] Field of Search ..... 400/194, 195, 196, 196.1, 400/207, 208

[56] References Cited

U.S. PATENT DOCUMENTS

| | | | |
|---|---|---|---|
| 764,342 | 7/1904 | Booth | 400/196.1 |
| 2,685,357 | 8/1954 | Koreska | 400/196.1 |
| 3,075,627 | 1/1963 | Kuckhoff | 400/208 |
| 3,814,231 | 6/1974 | Cappotto | 400/196.1 X |
| 3,989,132 | 11/1976 | Carson, Jr. | 400/196.1 X |
| 4,088,218 | 5/1978 | Depew | 400/196.1 X |
| 4,113,750 | 9/1978 | Isobe | 400/196 |
| 4,131,372 | 12/1978 | Hengelhaupt | 400/196.1 |

FOREIGN PATENT DOCUMENTS

| | | | |
|---|---|---|---|
| 2136777 | 2/1973 | Fed. Rep. of Germany | 400/196.1 |
| 2148950 | 4/1973 | Fed. Rep. of Germany | 400/196.1 |
| 2536645 | 3/1976 | Fed. Rep. of Germany . | |
| 2534535 | 2/1977 | Fed. Rep. of Germany . | |
| 2732362 | 3/1978 | Fed. Rep. of Germany . | |
| 2717076 | 10/1978 | Fed. Rep. of Germany | 400/196.1 |
| 1218146 | 12/1959 | France | 400/196.1 |
| 2291037 | 6/1976 | France . | |
| 2368365 | 5/1978 | France | 400/196.1 |

OTHER PUBLICATIONS

IBM Technical Disclosure Bulletin, "Ribbon Cartridge Exit Impedance," Dowd, Vol. 20 No. 11B Apr. 1978, pp. 4739–4740.

*Primary Examiner*—Ernest T. Wright, Jr.
*Attorney, Agent, or Firm*—Krass, Young & Schivley

[57] ABSTRACT

A replaceable cartridge containing an endless loop ink ribbon for use in printing units. The ribbon storage area inside of the cartridge is configured to guide the ribbon so that a large amount of ribbon may be stored in the allowed space while retaining favorable ribbon feed characteristics. The ribbon is guided by ledges formed on the inside surfaces of the cartridge between the ribbon inlet and outlet openings. The cartridge is to be constructed in halves and is designed with such symmetry that the halves are identical and so may be produced by the same tool or machine.

11 Claims, 6 Drawing Figures

INK RIBBON MAGAZINE FOR ENDLESS INK RIBBON CARTRIDGE

INTRODUCTION

The innovation relates to a replaceable ink-ribbon magazine for printing units, including a housing with a storage space enclosed by a substantially flat bottom surface, a cover surface substantially parallel to this and sidewalls running substantially perpendicularly to the cover and bottom surfaces, for receiving an endless ink ribbon in a plurality of loops which can be formed freely, as well as with an inlet and outlet opening for the ink ribbon, wherein the distance between the cover surface and the bottom surface is slightly greater than the width of the ink ribbon, and wherein, at opposite positions on the cover surface and bottom surface, ledges are arranged between the inlet and the outlet opening and aligned transversely to the general feed direction of the ink ribbon through the storage space, the distance between which ledges is less than the width of the ink ribbon.

Ink-ribbon magazines of this kind may be inserted into the ink-ribbon unit for printing units, wherein the part of the endless ink ribbon located outside of the ink-ribbon magazine runs through the printing unit and by means of suitable conveying units is pulled out of the ink-ribbon magazine at its outlet opening and pushed into the magazine at its inlet opening to form loops.

With ink-ribbon magazines of this type there is quite commonly a problem of accomodating as many ink-ribbon loops as possible in the storage space, to achieve as long a useful life as possible for the ink-ribbon magazine with the smallest possible space required. The ribbon thrust resulting from forcing a long length of ink ribbon into the storage space can however have the result that the ribbon can be pulled out of the outlet side only with difficulty or that when the ribbon is pulled out of the outlet opening, a number of loops of ribbon are pulled out at once.

In order to avoid this difficulty, it has already been proposed in German Unexamined Patent Application DE-OS2,534,535 to arrange the ledges about equidistant between the inlet and outlet opening so that the storage space is divided into an inlet space with a high ribbon thrust pressure and an outlet space with a low ribbon thrust. If the ribbon thrust in the inlet space exceeds a certain value, the individual ribbon loops are forced through between the ledges into the outlet space in which they lie loosely without exerting any pressure on the outlet opening. Although this prevents a number of ribbon loops from being pulled or impelled out of the outlet opening at the same time, still it allows only a relatively small amount of ink ribbon to be accomodated in this ink-ribbon magazine for a given volume of the latter, since half of the storage area is made up of the outlet area which receives only relatively few ribbon loops.

Moreover, the principle is known from German Application DT-OS2,536,645 of dividing the storage space into three spaces with the aid of a plurality of ledges, in which spaces, there is a gradual decline of the ribbon thrust up to the outlet opening. This embodiment is not only more complicated but also shows the same disadvantages as the embodiment according to DE-OS2,534,535.

The innovation is based on the problem of supplying an ink-ribbon magazine of the type mentioned at the outset which is simple to produce and which has a high ribbon storage capacity for a small volume.

To solve this problem, it has been proposed according to the innovation that the ledges be arranged near the outlet-side end of the storage space. In this way practically the whole of the storage space can be utilized for the storage of ribbon loops with a high ribbon thrust, whereby a large amount of ink ribbon can be stored in the storage area for a given volume of the ink-ribbon magazine. The ledges thereby nonetheless prevent any accumulation of ribbon loops in front of the outlet opening. The force required for pulling a ribbon loop through between the two ledges situated opposite one another is much less than the force that would be required to pull the loop out of the outlet opening when the latter is clogged up by the accumulated ribbon loops. The short distance between the ledges and the outlet opening insures however that this cannot happen, but rather that a half or whole loop of the ink ribbon lies loosely between the ledges and the outlet opening.

Many of the flat ribbon loops lie with the bend of the loop on one of the sidewalls of the housing. However the ink ribbon is more rigid in the region of the bend in the ribbon than in the straight section of the loops, so that a higher tension is necessary for pulling the ink ribbon between the two ledges at this point. Hence according to the innovation it has been proposed that the two ledges extend from each of the two opposite sidewalls of the housing up to a position near the respective other sidewall. In this way, in the immediate vicinity of each sidewall, the vertical clearance of the storage space between the cover and bottom surfaces is reduced by only one ledge height, so that near each sidewall the passage of the ink ribbon is facilitated, and thereby the stiffening effect of the loop formation plays no part.

In order to facilitate the sliding of the ink ribbon over the ledges and to protect the ink ribbon, the ledges preferably show a semicircular cross-section profile on the surfaces facing one another.

In order to insure under all conditions that a number of loops of ribbon cannot be pulled out at the same time through the outlet opening, in case for any reason a number of ribbon loops should overwhelm the ledges, it is proposed according to the innovation that the housing wall bounding the storage space on the outlet side be formed of two partial walls defining a ribbon outlet slit between them. It is sufficient to make this ribbon outlet slit wide enough so that the ink ribbon can be pulled through loose.

On its inlet side the housing, for joining to a ribbon storage device, is substantially open, wherewith a ribbon-retaining and guiding element is preferably arranged at the inlet-side end of each sidewall, which element extends substantially perpendicularly to the particular sidewall over less than half of the width of the inlet opening. This ribbon-retaining and guiding element insures that when the transporting protective mechanism of a new ink-ribbon magazine is removed, the loops of ink ribbon which are under a relatively high ribbon thrust pressure in the magazine cannot be impelled out through the inlet opening. On the other hand the inlet opening is large enough to make possible the storage of the ribbon in the storage space. This further development may also be advantageously provided for other magazines. In order to facilitate the storing of the ribbon in the ink-ribbon magazine through a storing feed-in device, each ribbon-retaining and guiding element preferably has a ribbon-guiding surface near its free end at the side facing toward the storage space. This, for example, prevents the ink ribbon from winding around the rollers when the ink ribbon is being fed in for storage by the use of a pair of driving rollers rolling on one another. Preferably for this the ribbon-retaining and guiding elements extend over only part of the height of the housing, so that for example they can engage in a circumferential annular slot on the storing feed-in rollers and thereby insure the release of the ink ribbon from the storing feed-in rollers. Preferably the cover surface and the bottom surface respectively project outward beyond the sidewalls. In the space thus formed, which is bounded on three sides and open to the outside, can be accommodated the part of the ink ribbon running outside of the storage space between outlet opening and inlet opening to form a Mobius strip, when the ink-ribbon magazine is being transported.

In order to achieve the most uniform possible formation of loops of the ink ribbon in the storage space and an unobstructed conveying of the ink-ribbon loops through the storage space, the latter is preferably so constructed that its base surface bounded by the sidewalls, the ledges and the ribbon-retaining and guiding elements is essentially rectangular.

Preferably for this the housing is constructed substantially symmetrically both with respect to its vertical longitudinal median plane running equidistant between the sidewalls and perpendicularly to the cover and the bottom surface and also with respect to a horizontal median plane running parallel to and equidistant between the cover and the bottom surface.

In order to simplify the production of the housing and to facilitate the insertion of the ink ribbon in the housing, the latter preferably consists of at least two housing parts, one of which includes the bottom surface and the other the cover surface. Such a division for example facilitates the removal of the housing parts from the mold when these are fabricated as injection molded parts. The assembling of the two housing parts, after the insertion of the ink ribbon, is managed particularly simply if the two housing parts can be joined together by means of plug connection elements. To prevent the two housing parts from unintentionally falling apart during the manipulation of the ink-ribbon magazine and the highly staining ink ribbon from leaving spots anywhere, the plug connection elements are preferably constructed so that the housing parts can be locked unreleasably to one another.

According to one especially simple embodiment, each pair of cooperating plug connection elements consists of a stud arranged on one housing part and a slip-on mount arranged on the respective other housing part to receive the stud. For this the stud and slip-on mount may be so constructed that when they are brought together they become deformed and prevent any separation of the housing parts other than by the destruction of the housing. The fabrication of the ink-ribbon magazine can be achieved in a particularly simple and economical way by having the two parts of the housing constructed to be identical. When the housing is fabricated for example from plastic injection molded parts, a single mold is then sufficient for the fabrication of the two housing parts. An identical construction of the housing parts is possible for example by dividing the housing in such a manner that each of the housing parts comprises, in addition to the cover or bottom surface, a sidewall and the partial wall connected with this on the outlet side of the storage space as well as the ribbon retaining and guiding elements connected with this sidewall.

BRIEF DESCRIPTION OF THE DRAWING

Further features and advantages of the innovation are seen from the following description, which in connection with the accompanying figures describes the innovation on the basis of one embodiment. In these.

DETAILED DESCRIPTION OF THE SPECIFIC EMBODIMENT

Figure 1:
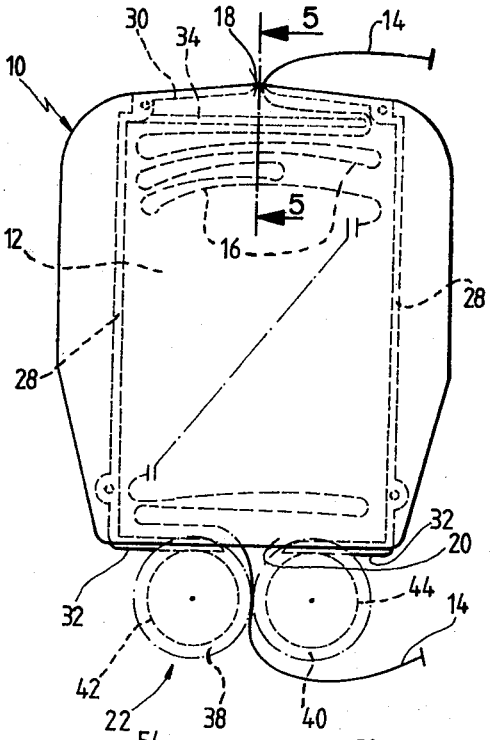
FIG. 1 shows a top plan view of the magazine according to the innovation with a diagrammatically indicated storing feed-in device for the ink ribbon.

The ink-ribbon magazine represented in FIG. 1 includes a housing designated in general as 10 with a storage space 12 for receiving an endless ink ribbon 14 which is stored in the storage space 12 in a number of freely formed ribbon loops 16. The ink ribbon 14 leaves the storage space 12 through an outlet opening 18 and is again introduced into the storage space 12 through an inlet opening 20 by means of an ink ribbon drive, which is designated in general as 22. Between the outlet opening 18 and inlet opening 20 the ink ribbon 14, forming a Mobius strip, runs through a printing unit, not shown.

Figure 3:
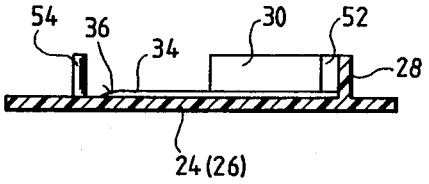
FIG. 3 shows a section along line 3—3 in FIG. 2.
Figure 4:
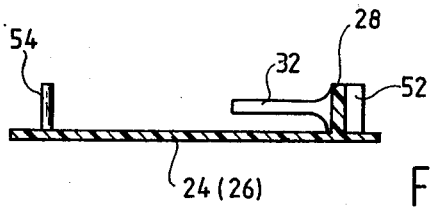
FIG. 4 shows a section along line 4—4 in FIG. 2.
Figure 5:
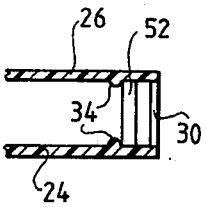
FIG. 5 shows a partial section along line 5—5 in FIG. 1.

The storage space 12 is bounded by a bottom plate 24 (FIG. 5), a cover plate 26, both of said bottom and cover plates 24 and 26 defining substantially planar members, parallel to one another. Referring now to FIGS. 3 and 4, each of the bottom and cover plates 24 and 26 has a sidewall 28 which runs essentially parallel to one another and extends perpendicularly to the bottom plate 24 and cover plate 26 and between these latter, and on the outlet side the storage space 12 is bounded by two transverse walls 30 running between the bottom plate 24 and the cover plate 26 and defining the slit-shaped outlet opening 18 between them. On the inlet side the storage space 12 is substantially open up to the two ribbon-retaining and guiding elements 32, in the nature of elongate members or spring fingers, which are arranged at the inlet side ends of each side wall 28 and which extend perpendicularly to the respective side wall 28 over less than half the width of the storage space 12.

Near the upper end of the storage space 12 as shown in FIG. 1 and at a small distance from the transverse walls 30 is arranged a ledge 34 on both the bottom plate 24 and the cover plate 26 respectively, which extend perpendicularly to the side walls 28 at positions opposite to one another on the bottom plate 24 and on the cover plate 26 and extend transversely to the general feed direction of the ink ribbon 14. While the distance between the bottom plate 24 and the cover plate 26 is somewhat larger than the width of the ink ribbon 14, the height of the ledges 34 is dimensioned so that their mutual distance apart is substantially less than the width of the ink ribbon 14. Thus they form an obstacle for the ribbon loops 16 pushed from the inlet opening 20 to the outlet opening 18, on which obstacle the ribbon loops 16 accumulate. This makes it possible to push in ribbon loops 16 into the storage space 12 with a considerable pressure, so that a large amount of ink ribbon 14 can be stored in the storage space 12 without the ribbon loops 16 therewith being pressed against the transverse walls 30 and the outlet opening 18 becoming clogged up. When the thrust pressure on the ribbon 14 becomes very high, the ribbon loops 16 lying against the two ledges 34 become kinked up and are forced between the two ledges 34, so that one ribbon loop 16 lies in the space between the transverse walls 30 and the ledges 34. This ribbon loop 16 can then be easily pulled out of the outlet opening 18 without too much force having to be used.

Even though the ribbon loop 16 is prevented from being forced between the ledges 34 by the ribbon loops 16 pressing it from behind, it can nonetheless be pulled between the two ribs 34 by a very slight force exerted. In any case this force exerted is very much smaller than the tensile force which would be required in order to pull the ink ribbon 14 out of the outlet opening 18 when there is a damming up of the ink-ribbon loops 16 directly on outlet opening 18.

The sliding of a ribbon loop 16 over the ledges 34 is facilitated by the fact that the ledges 34 have a semicircular cross section (FIG. 5) on the sides turned toward one another.

As is seen in FIG. 3, each ledge 34 starts from one of the sidewalls 28 and extends only up to the vicinity of the other sidewall 28, the two ledges 34 starting from the sidewalls 28 opposite one another. In this way, in the immediate vicinity of the two sidewalls 28 the distance between bottom plate 24 and cover plate 26 is diminished by the height of only one ledge 34 in each case. Thereby the resistance caused by the ledges 34 to the ink ribbon 14 is reduced. In the vicinity of the sidewalls 28 the lowest radius of curvature of the ink ribbon loops 16 is encountered. The low radius of curvature causes the ink ribbon 14 to have a higher resistance to being pulled through the ledges 34. Thus, the higher resistance of the ink ribbon 14 to being pulled through the ledges 34 is compensated for by providing only one ledge 34 in this vicinity. Each free end 36 of each ledge 34 is tapered as shown in FIG. 3, to prevent the ink ribbon 14 from getting caught thereon.

The ribbon conveying device 22 indicated in FIG. 1 includes two driving rollers 38 and 40 between which the ink ribbon 14 runs through. The ribbon-retaining and guiding spring fingers 32 here are to prevent the ink ribbon 14 from winding around the driving rollers 38 or 40. At the same time they should insure that the ink ribbon 14 is introduced into the storage space 12 with the formation of ribbon loops 16 with no difficulty. For this the guide elements 32 are constructed in the manner seen in FIG. 4, so that they can engage in a circumferential groove 42 and 44 in the driving rollers 38 and 40. Near their free end, on their respective side turned facing the storage space 12, the guide elements 32 each show a guide surface 46, the radius of curvature of which substantially coincides with the radius of curvature of the respective driving rollers 38 and 40.

Figure 6:
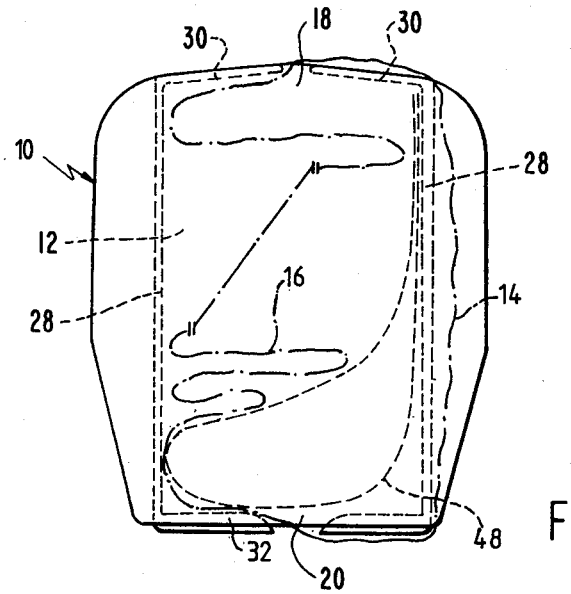
FIG. 6 shows a top plan view corresponding to FIG. 1 of the ink-ribbon magazine according to the innovation in the transporting state.

If the magazine is located in its transporting position as represented in FIG. 6, then the elements 32 serve to retain an elastic flexible protective strip 48, which is inserted onto the storage space 12 in the manner represented in FIG. 6 and lies in front of the inlet opening 20 so that the storage space 12 is closed off substantially tightly by the protective strip 48. In this way the ribbon loops 16 are prevented from falling out of the storage space 12 during the transporting of the ink-ribbon magazine, and also the ink (not shown) in the ink ribbon 14 is prevented from drying out during a long storage period. But if on the other hand the protective strip 48 is withdrawn from the storage space 12 immediately before the ink-ribbon magazine is used, the elements 32 prevent the ribbon loops 16, which are under a certain thrust pressure, from being impelled out of the storage space 12.

As is to be seen in the figures, the bottom plate 24 and the cover plate 26 project out somewhat over the sidewalls 28, so that a space bounded on three sides and open to the outside is formed. In this space, during transporting, is lain the section of the ink ribbon 14 running outside the storage space 12 between the outlet opening 18 and the inlet opening 20, so that this section cannot be damaged.

Figure 2:
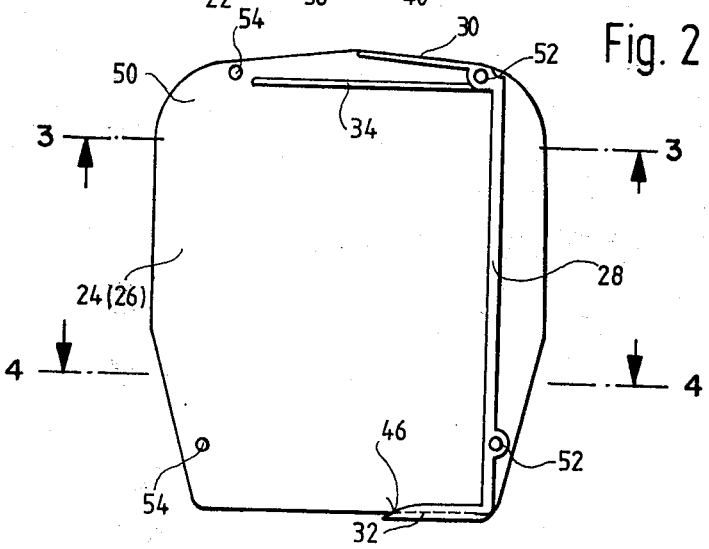
FIG. 2 shows a top plan view of one of the two identical housing parts of which the ink-ribbon magazine according to the innovation consists.

The housing 10 represented in FIG. 1, consists of two housing parts 50 as shown in FIG. 2, each of which includes one bottom surface 24 or cover surface 26, one sidewall 28, one transverse wall 30, one ribbon-retaining and guiding element 32 as well as one ledge 34. The two housing parts 50 are joined together by plug connection elements, comprising slip-on mounts 52 and studs 54. Each housing part 50 shows a slip-on mount 52 arranged on the sidewall 28 near the inlet end of the sidewall 28 and in transverse wall 30 near the sidewall 28 for receiving a stud 54 arranged at a corresponding position on the other housing part 50. If the housing part 50 represented in FIG. 2 is rotated around a vertical axis lying in the plane of the drawing, so that the bottom plate 24 or cover plate 26 is open, and if the housing part 50 thus arranged is placed on another housing part 50 in the position represented in FIG. 2, the housing 10 represented in FIG. 1 can be assembled. The extraordinary advantage of this construction of the housing part 50 is that only one mold (not shown) is needed for its production, which considerably reduces the manufacturing cost of the ink-ribbon magazine. Thus each housing part 50 can be produced as a single simple injection molded part from a preferably transparent plastic. After the ink ribbon 14 is inserted, the two housing parts 50 are assembled and pressed against one another to engage stud 54 within slip-on mount 52. With an approximately conical design of the stud 54 and a complementary conical shape of the recesses on the slip-on mounts 52, a suitable pressure on the two housing parts 50 makes it possible to achieve a firm joint between the two housing parts 50.

The ink-ribbon magazine is simple and economical to produce and has a large ribbon storage capacity for small outer dimensions.

The embodiments of the invention in which an exclusive property or privilege is claimed are defined as follows:

1. A replaceable endless ink ribbon magazine for use with a printing unit of the type having a printing mechanism and ink ribbon drive means for feeding an endless ink ribbon through said printing mechanism, and being removable from said printing unit independently of said drive means comprising:

first and second planar members disposed in spaced parallel relationship to each other;

first and second sidewalls inter-connecting said first and second planar members to form an enclosure having an inlet end and an outlet end, each of said sidewalls extending longitudinally from said inlet end to said outlet end;

first and second spaced apart transverse walls disposed at said outlet end of said enclosure and extending between said first and second sidewalls to form an outlet opening therebetween in said enclosure;

said enclosure including an inlet opening therein at said inlet end thereof for removably receiving said ink ribbon drive means therewithin;

said ink ribbon drive means including a pair of rollers having spaced parallel axes of rotation adjacent the magazine when in the printing unit, each roller having a circumferential groove formed therein; and first and second stationary elongate members extending toward each other from said first and second sidewalls at the inlet end of said enclosure and being received within the groove in said rollers for guiding said ribbon from said drive means into the enclosure and for retaining said ribbon within said enclosure, each of said elongate members being interposed between and spaced from said first and second planar members, whereby said elongate members automatically strip the ribbon from the drive rollers and properly align the magazine with said drive rollers.

2. An ink ribbon magazine as defined in claim 1, characterized in that said first and second elongate members each have a ribbon guiding surface near its free end on the side facing the interior of said enclosure.

3. An ink ribbon magazine as defined in claim 2, characterized in that the side of each elongate member facing the interior of the enclosure is curved in geometry.

4. An ink ribbon magazine as defined in claim 1, wherein said magazine is constructed substantially symmetrically both with respect to a vertical plane running perpendicularly to first and second planar members and equidistant between first and second sidewalls and with respect to a horizontal plane running parallel to and equidistant between said planar members.

5. An ink ribbon magazine, as defined in claim 4, wherein said magazine consists of two housing parts, one of which includes the first planar member and the other of which includes the second planar member.

6. An ink ribbon magazine as defined in claim 5, characterized in that the housing parts are joined together by a plurality of plug connection elements.

7. An ink ribbon magazine as defined in claim 6, characterized in that the housing parts are joined to one another undetachably by said plug connection elements.

8. An ink ribbon magazine as claimed in claim 7, characterized in that each pair of plug connection elements interacting with each other includes a stud arranged on one of the housing parts and a slip-on mount for receiving the stud arranged on the other respective housing part.

9. An ink ribbon magazine as defined in claim 8, characterized in that the two housing parts are structurally identical.

10. An ink ribbon magazine as defined in claim 9, characterized in that each of the housing parts includes one of said planar members, one of said sidewalls, one of said transverse walls and one of said elongate members.

11. A replaceable endless ink ribbon magazine for use with a printing unit of the type having a printing mechanism and ink ribbon drive means for feeding an endless ink ribbon through said printing mechanism, and being removable from said printing unit independently of said drive means comprising:

first and second planar members disposed in spaced parallel relationship to each other;

first and second sidewall means for inter-connecting said first and second planar members to form an enclosure having an inlet end and an outlet end, each of said sidewall means extending longitudinally from said inlet end to said outlet end;

first and second spaced apart transverse wall means disposed at said outlet end of said enclosure and extending from said first and second sidewall means to form an outlet opening therebetween;

said enclosure including an inlet opening at said inlet end thereof for removably receiving said ink ribbon drive means therebetween;

first and second spaced apart spring fingers extending laterally inwardly toward one another at said inlet end of said enclosure and received within said drive means for guiding said ribbon from said drive means into said enclosure and for retaining said ribbon within said enclosure;

wherein said magazine is symmetrical with respect to a central longitudinal axis, said magazine being formed in two identical housing parts being joined together undetachably by connection elements, each of said housing parts including one of said planar members, one of said sidewall means, one of said transverse wall means, one of said spring fingers, and at least one of said connection elements to cooperate with another connection element arranged on the other respective housing part.

* * * * *